United States Patent [19]

Turner

[11] Patent Number: 4,660,913

[45] Date of Patent: Apr. 28, 1987

[54] ELECTRICAL PLUG AND SOCKET ASSEMBLIES

[76] Inventor: Philip R. Turner, 10660 Bobwhite Beach, Whitmore Lake, Mich. 48189

[21] Appl. No.: 700,270

[22] Filed: Feb. 11, 1985

[51] Int. Cl.[4] ..... H01R 25/00

[52] U.S. Cl. ..... 339/49 R; 339/154 A; 339/157 C; 339/196 M

[58] Field of Search ..... 339/47–49, 339/75, 196 R, 196 M, 206 R, 206 P, 157, 156, 154

[56] References Cited

U.S. PATENT DOCUMENTS

| | | | |
|---|---|---|---|
| 1,159,567 | 11/1915 | Burton | 339/47 R |
| 1,967,021 | 7/1934 | Gary | 339/75 R |
| 2,190,230 | 2/1940 | Cole | 339/75 R |
| 2,449,660 | 9/1948 | Lawhorne | 339/47 R |
| 2,465,419 | 3/1949 | Barany | 339/49 R |
| 2,474,356 | 6/1949 | Harris | 339/157 C |
| 2,714,712 | 8/1955 | Riccardelli | 339/157 C |
| 4,099,824 | 7/1978 | Schoppelrey | 339/157 C |

FOREIGN PATENT DOCUMENTS

| | | | |
|---|---|---|---|
| 943983 | 10/1948 | France | 339/47 R |

*Primary Examiner*—Gil Weidenfeld
*Assistant Examiner*—David Pirlot
*Attorney, Agent, or Firm*—James M. Deimen

[57] ABSTRACT

Electrical plug and socket assemblies for interconnecting electrical cables and extension cords comprising one or two piece molded bodies that form a streamlined bulbous shape when engaged. The plug and socket are engaged by pulling in substantially opposite directions and disengaged by pushing apart. The engagement of the plug with the socket thus tightens when the cables are pulled as distinguished from a conventional plug and socket. The molded plastic portions of each one or two piece plug or socket body are identical, the metal prongs or contacts being insertable during assembly to make a plug or socket respectively. The one piece body includes a hinge joining the outside female portion to the inside male portion and can be molded as one unit. The two piece body is identical except for the deletion of the hinge joining the pieces. Upon assembly of the cable and prongs or contacts into the male portion, the male portion is folded and secured into the female portion. For multiple cable connection to a single cable, a circular ring having a plurality of inwardly extending sockets and a single inwardly extending plug is provided. The configuration of the ring provides for a tightening of the engagement with a complementary plug or socket in the event of any pulling on the attached cables. The ring and optionally the plug or socket can be simply plastic molded about the metal conductors therewithin. Also disclosed are two connectors suitable for joining the new electrical plug and socket assemblies to conventional plugs or sockets.

27 Claims, 17 Drawing Figures

ELECTRICAL PLUG AND SOCKET ASSEMBLIES

BACKGROUND OF THE INVENTION

The field of the invention comprises electrical plugs and sockets for interconnecting electric cables and extension cords. In particular, applicant's invention is directed to plugs and sockets that can be conveniently attached and detached without tools but cannot be detached by pulling on the extension cords or cables.

Common extension cords and cables for household and office use at 110 volts and 15 amperes AC utilize simple two or three prong plugs and sockets. The plugs and sockets are attached and detached axially by pushing together or pulling apart respectively. The plugs and sockets can easily be detached inadvertently with a sudden pull, in particular when being dragged about and around obstacles.

Common 220 volt AC extension cord plugs and sockets are typically of a larger size and incorporate bayonet or other latching means on at least one prong of the plug engageable with a twist relative to the socket to prevent inadvertent disengagement. Such extension cords are frequently used in construction projects for portable electric hand tools. With eventual wear the latching means fails and the extension cords become easily detached as they are dragged about obstacles.

As a result over the years more sophisticated means to latch plugs and sockets together have been developed. U.S. Pat. No. 904,603 illustrates a cable connector for a single wire wherein the plug and socket are identical and external rotatable sleeves having camming means attach the plug and socket together. U.S. Pat. No. 1,835,251 discloses a substantially conventional plug and socket with external latches to positively retain the plug and socket together. French Pat. No. 811,155 discloses a bulbous identical plug and socket for dual wires wherein the units are pushed together and twisted to positively engage the electrical contacts and retain the units together.

U.S. Pat. No. 2,506,979 discloses identical plug and socket connectors that telescope together and latch with a slight twist and U.S. Pat. No. 3,252,124 discloses a push in and twist identical connector pair for multiple pole or wire connection. In general the prior art plug and socket connectors rely upon the prongs or external devices to positively retain the connectors together, the connectors otherwise being easily detachable with a simple pull.

SUMMARY OF THE INVENTION

With a view toward eliminating the inadvertent separation of plug and socket, it is an object of applicant's invention to provide a plug and socket that engage with a substantially axial pull and disengage with a substantially axial push. Thus, inadvertent pulls on the extension cords only serve to tighten the connection between the plug and socket.

Externally the plug and socket as engaged appear bulbous. With the exception of the metal prongs of the plug and metal contacts of the socket, the plug and socket bodies are identical in configuration and preferably molded of a plastic such as polypropylene or a rubber commonly used for electrical plugs and sockets. The molded body comprises a female portion containing a cavity within which the male portion substantially fits upon assembly. The prong or contact assemblies are inserted into the male portion to create a plug or socket and then the male portion is fastened into the female portion. In an alternate embodiment the male and female portions are joined along a hinge line and can be molded as one piece, the prongs or contacts inserted, the electrical cable connected and the male portion folded and secured into the female portion.

The novel interconnection of the plug and socket and the bulbous external configuration permit the cable or extension cord to be snaked through doorways around door jambs and other obstructions without becoming caught and disengaging. Another embodiment of the plug and socket comprises a "permanent" plug or socket formed by molding plastic or rubber about a previously attached cable and prong or contact assembly. To provide the attachment of cables equipped with the new plugs and sockets, adapter units that comprise a conventional plug at one end and applicant's socket at the other end are either substantially L-shaped to reduce the likehood of detachment from a wall socket or shaped almost identically to the new plugs and sockets.

A multiple socket interconnector for attaching multiple cables to a single cable comprises a circular ring having a plurality of inwardly extending sockets and a single inwardly extending plug. The inwardly extending plug and multiple sockets provide engagement with a pull and disengagement with a push as with separate plugs and sockets. The ring multiple socket is preferably constructed by molding a solid plastic or rubber form about the conductors.

DESCRIPTION OF THE PREFERRED EMBODIMENTS

Figure 1:
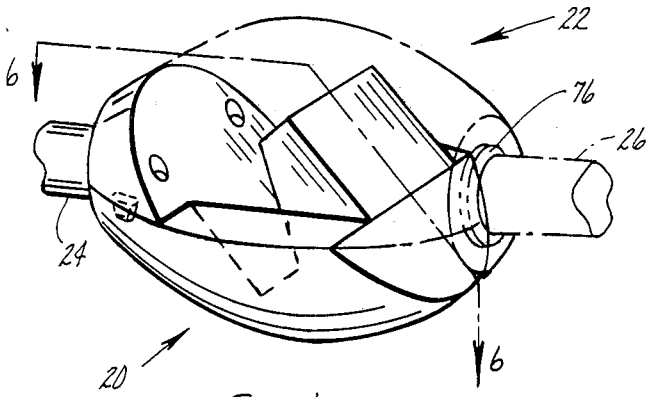
FIG. 1 is a perspective view of a plug and socket assembly according to the invention.
Figure 2:
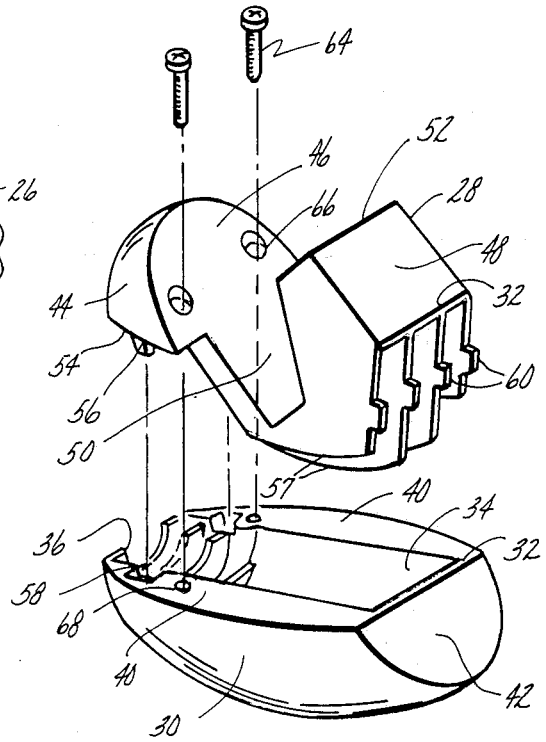
FIG. 2 is an exploded perspective view of a plug or socket body.
Figure 3:
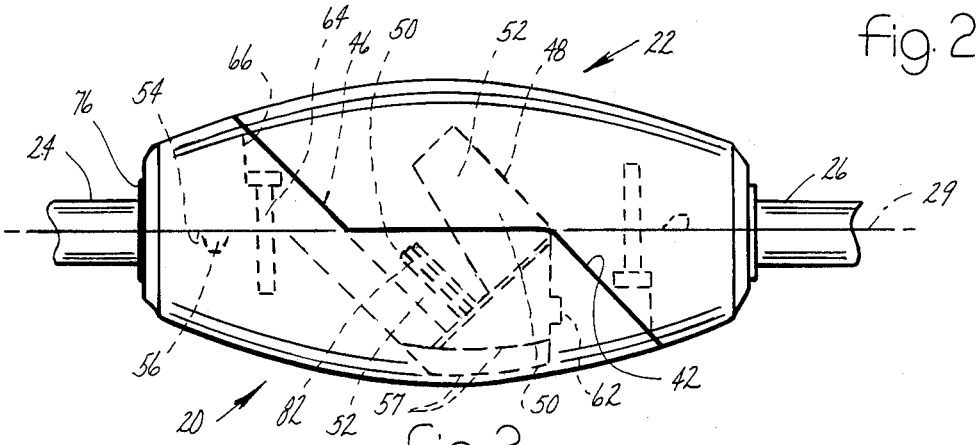
FIG. 3 is a side view of the plug and socket assembly.
Figure 4:
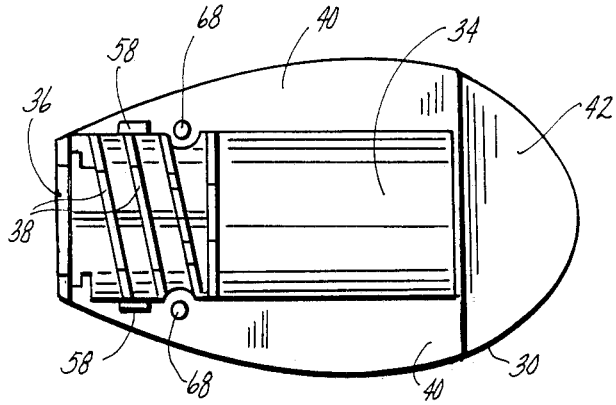
FIG. 4 is a top view of the female part of the body shown in FIG. 2.
Figure 5:
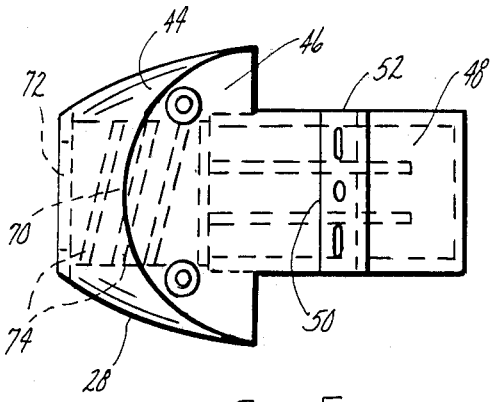
FIG. 5 is a top view of the male part of the body shown in FIG. 2.
Figure 10:
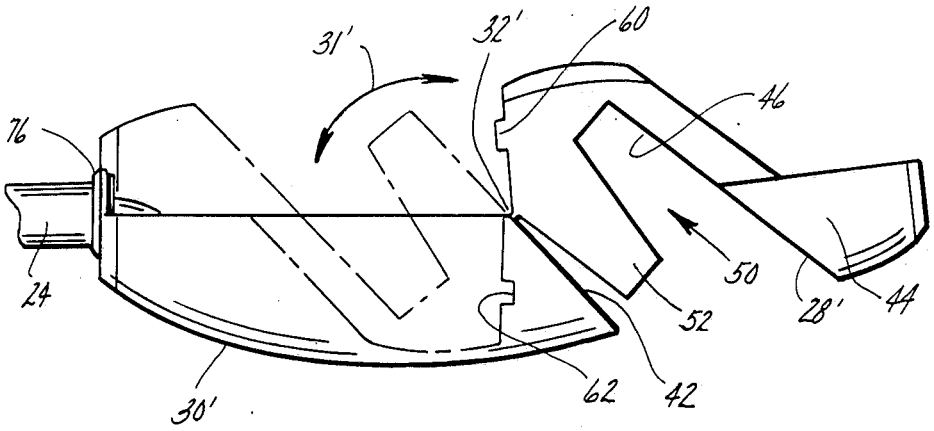
FIG. 10 is a side view of a single piece plug or socket body.

FIGS. 1 and 3 illustrate a plug generally denoted by 20 and a socket generally denoted by 22 attaching a pair of conventional three wire cables 24 and 26 together. The socket 22 is shown ghosted in FIG. 1. FIGS. 2, 4 and 5 illustrate the male 28 and female 30 parts of the body for either the plug 20 or socket 22. The male 28 and female 30 parts of the body are preferably molded from a suitable insulative and strong plastic or rubber that is approved for electrical usage. A suitable plastic is polypropylene commonly used for plugs and sockets and possessing the advantage that movable hinges ("living hinges") may be integrally formed to join body parts. Such an alternative construction is illustrated in FIG. 10 wherein the male part 28' and female part 30' are integrally joined by a hinge 32' and the body is molded as one piece. The male part 28' is thereby rotatable into the female part 30' as indicated by arrow 31'. The plug 20 and socket 22 are described as two separate parts below for simplicity, however, the assembly of either the plug or the socket applies to either the two part body of FIG. 2 or the hinged body of FIG. 10. The hinge line is designated 32 in FIG. 2 on both body parts to make clear where the parts can be joined by the hinge.

Referring to FIGS. 2 and 4 the female part 30 forms the bulk of the bulbous exterior of the body and has therein a cavity 34 extending substantially the length of the part. At the cable end of the female part 30 is a semi-elliptical half aperture 36 for the cable and a plurality of parallel semi-elliptically apertured integral plates 38 extending upwardly within the cavity 34. The upper surface 40 of the female part 30 lies in a plane including the axis 29 (FIG. 3) and the end 42 opposite the cable end is planar and oblique to the upper surface 40 and axis 29 of the part.

Figure 6:
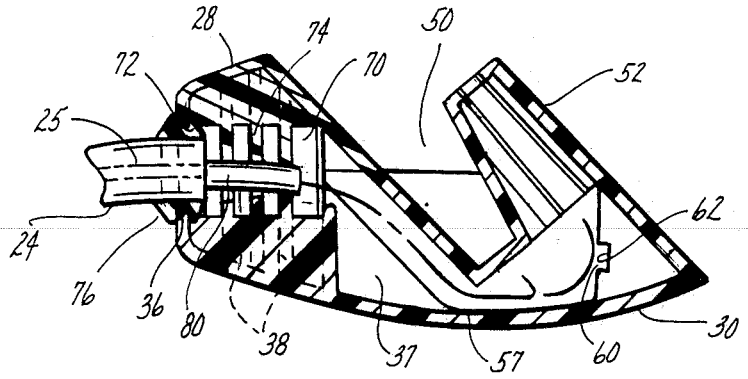
FIG. 6 is a cross section of the assembled body taken along the line 6—6 of FIG. 1.

Referring to FIGS. 2 and 5 the male part 28 includes a small portion 44 of the bulbous exterior and two parallel planar surfaces 46 and 48 spaced apart by the prong cavity 50 and the socket extension 52. The two parallel planar surface 46 and 48 are oblique to a pair of planar surfaces 54 lying in a plane including the axis 29 (FIG. 3) and underside each side of the small exterior portion 44. A pair of alignment tabs 56 on either side extend beneath the pair of surfaces 54 and are engageable with alignment holes 58 in the surface 40 of the female part 30. A second plurality of alignment tabs 60 are adapted to engage a horizontal slot 62 (FIG. 3) located in the female part 30 cavity 34 below the oblique surface 42. The male part 28 is secured to the female part 30 by a pair of screws 64 in countersunk holes 66 and threaded holes 68. As best shown in FIGS. 5 and 6 the male part includes a cavity 70 at the cable end, a semi-elliptical half aperture 72 and a plurality of parallel semi-elliptically apertured integral plates 74 all of which are opposed to the half aperture 36 and plates 38 in the cable end of the cavity 34 of the female part 30.

Figures 8, 9:
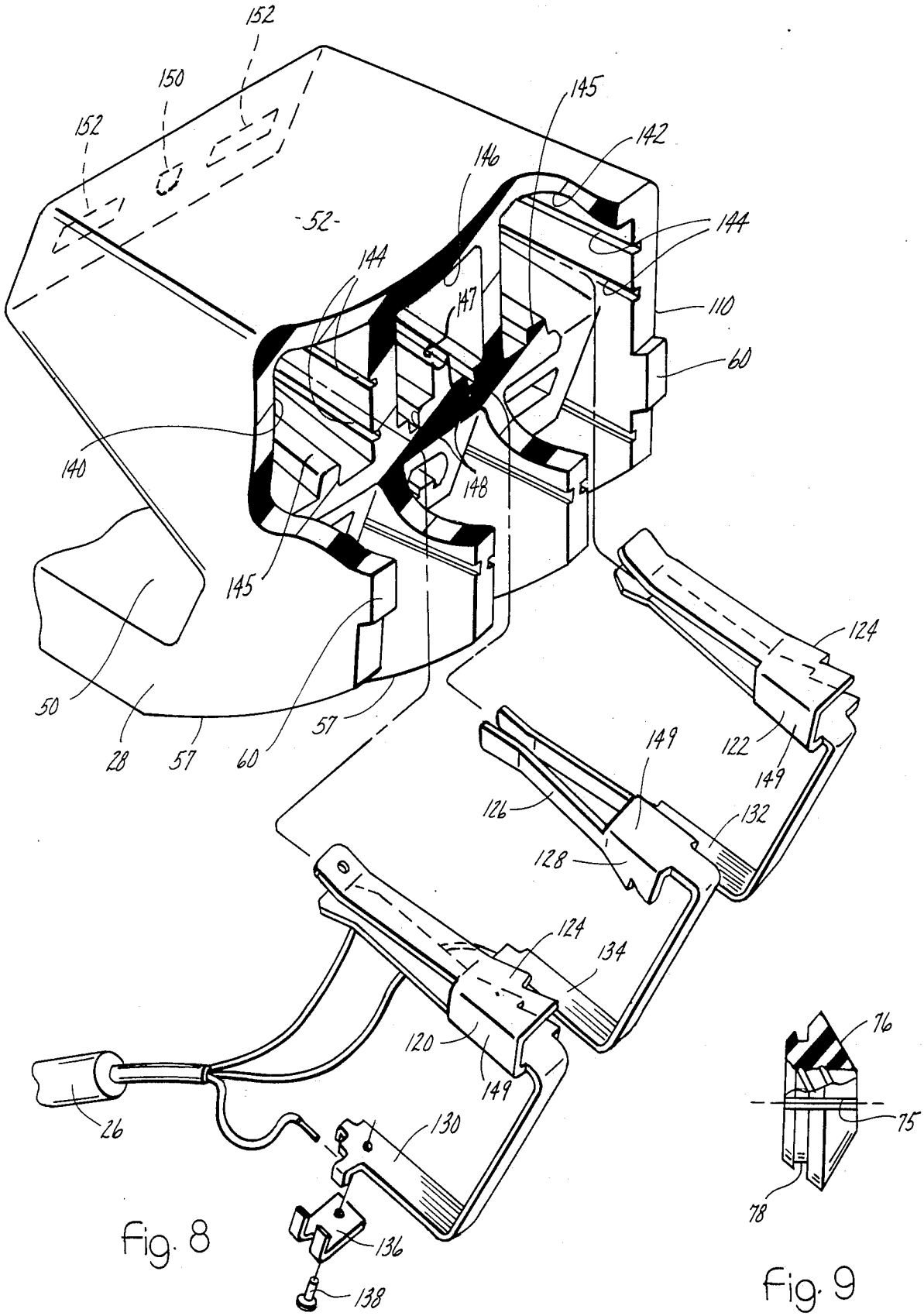
FIG. 8 is an exploded perspective detail of the socket contact assembly.
FIG. 9 is a partially cut away side view of the wire grommet.
Figure 15:
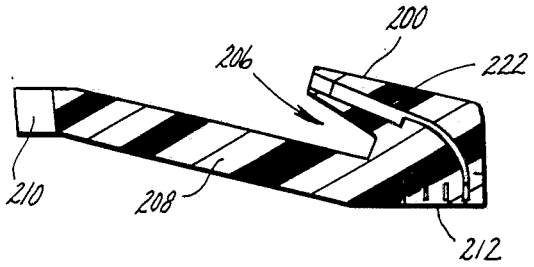
FIG. 15 is a partial cross section of the ring taken along the line 15—15 of FIG. 11.

A grommet 76 as shown in FIG. 9 may be fitted in the elliptical aperture 36, 72 (FIGS. 4, 5) to tightly surround and seal the aperture about a relatively small cable 25. The grommet 76 includes an elliptical slot 78 to sealingly grip the edge of the elliptical aperture. The plates 38 and 74 are descendingly relieved by the elliptical apertures therethrough to tightly grip the inner insulated wires 80, or, alternatively, the plates 38 and 74 grip the outer insulation of a cable which in turn can be extended further into the cavity 34, 70 of the body depending upon the cable diameter. Thus, the apertures provide means to grip the cable from the largest aperture 36, 72 without the grommet 76 to the smallest aperture with the grommet inserted. The plates 38, 74 provide the intermediate size apertures for intermediate size cables. The slot 75 in the grommet 76 permits the grommet to fit in the aperture 36, 72 about a cable with sufficient flexibility to permit the male part 28 to be fully seated in the female part 30 at the grommet end.

As shown in FIGS. 1 and 3 the identical plug 20 and socket 22 bodies nest into engagement to form the complete bulbous plug and socket combination. Most importantly, the prong cavities 50 are complementary to the contact extensions 52 of each molded body. The oblique planar surfaces 46 of each body engage the oblique planar and parallel surfaces 42 and 48 of the other body. Relative movement for engagement and disengagement of the plug 20 and socket 22 is substantially parallel to the planes 46 and 42, 48. Thus, an axial pull on the cables 24 and 26 results in a tightening of the engagement between the plug and socket. The contact extension 52 of each body is located deeply within the cavity 34 of the other body. Thus, the axial pulling force is not only resisted by the other contact extension 52 but also by the female part 30 of the body surrounding the cavity 34 and in front of the alignment tabs 60 and slot 62. An exceptionally strong engagement is thereby created. The alignment tabs 60 and slot 62 and the alignment tabs 56 and holes 58 assure that the male part 28 is tightly fitted into the cavity 34 in the female part 30. With the male part 28 fitted deeply in the cavity 34 strength is maximized. The bottom 57 of the sidewalls and interior walls of the male part are shaped to fit against the cavity 34 floor further reinforcing the structure.

Figure 7:
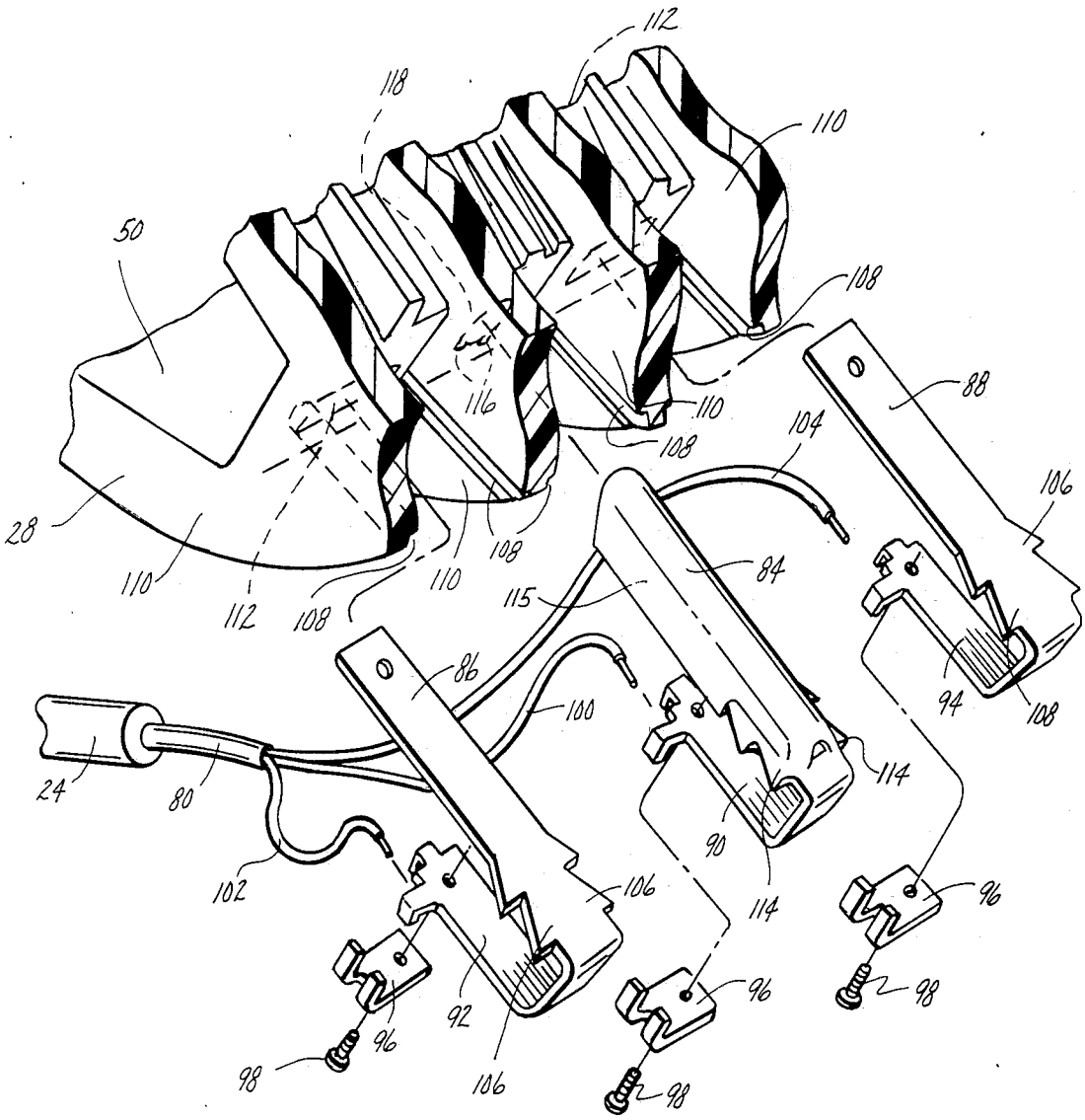
FIG. 7 is an exploded perspective detail of the plug prong assembly.

In FIG. 3 as shown at 82 the prongs of plug 20 are located in the prong cavity of plug 20 and inserted in the contact extension of the socket 22. The prongs are assembled into a male part 28 as illustrated in FIG. 7. The prongs are positioned in a single row with the ground prong 84 in the center and the hot prongs 86 and 88 on either side. The hot prongs are flat and the ground prong formed into a channel. Each prong forms one side of a relatively deep metal U-shape, the other sides 90, 92 and 94 each being formed to retain a clamp 96 and screw 98. A ground wire 100 and hot wires 102 and 104 from the cable 24 are each attached with the clamps 96 to the respective U-shaped prongs. The hot prongs 86 and 88 each include barbs 106 extending sideways therefrom for engagement with slots 108 formed in the side walls 110 to each side of each hole 112 through which the prongs extend into the prong cavity 50. The ground prong 84 includes sideways extending barbs 114 adapted to engage sidewall slots 108 and the prong channel sides 115 engage parallel slots 116 formed in the bottom of the ground prong hole 118. Once the prongs are pushed into and through the respective holes 112 and 118 the barbs 106 and 114 prevent the prongs from being retracted.

The contacts are assembled into a male part 28 as illustrated in FIG. 8 to form a socket. The hot contacts 120 and 122 are positioned sideways with locking barbs 124 extending to one side. The ground contact 126 is positioned downwardly with barbs 128 extending downwardly. The contacts each form one side of U-shaped metal forms, the other sides 130, 132 and 134 each being formed to retain a clamp 136 and screw 138 for the wires from the cable 26. The contact extension 52 of the male part 28 includes three substantially square holes therethrough in a row. The hot contacts 120 and 122 are inserted into the right 140 and left 142 holes with the barbs 124 engaging parallel slots 144 in one sidewall of each holes to prevent retraction from the holes. The ground contact 126 is inserted in the center hole 146 with the barbs 128 engaging parallel slots 148 in the bottom of the hole 146. At the tip of the contact extension 52 the apertures are shaped and sized to accept the prongs of the plug 20 as shown at 150 for the ground prong 84 and 152 for the hot prongs 86 and 88 (FIG. 7).

Extending upwardly from the floor of tapered holes 140, 142 and 146 are ribs 145 in holes 140 and 142 and rib 147 in center hole 146. The hot contacts 120 and 122 rest on the ribs 145 which in turn extend substantially the full length of the holes 140 and 142. The rib 147 is located under ground contact 126, however, the rib 147 which also extends substantially the full length of the hole 146, supports the ground prong 84 when inserted between the ends of the ground contact 126. In addition, the inside walls of the holes 140, 142 and 146 opposite the slots 144 engage the portions 149 of the hot and ground contacts opposite the barbs 124 and 128. Once pushed into the holes 140, 142 and 146, the hot and ground contacts are firmly positioned for engagement by the prongs.

Thus, the insertion of the prongs or the contacts in a male part 28 determine a plug or socket configuration, the molded plastic body and other fittings all being identical. With applicant's configuration the plug and the socket are identical in size and shape and fit together to form a symmetric streamlined bulbous shape that will not separate when pulled and is unlikely to snag when pulled about obstacles such as door jambs.

Figure 11:
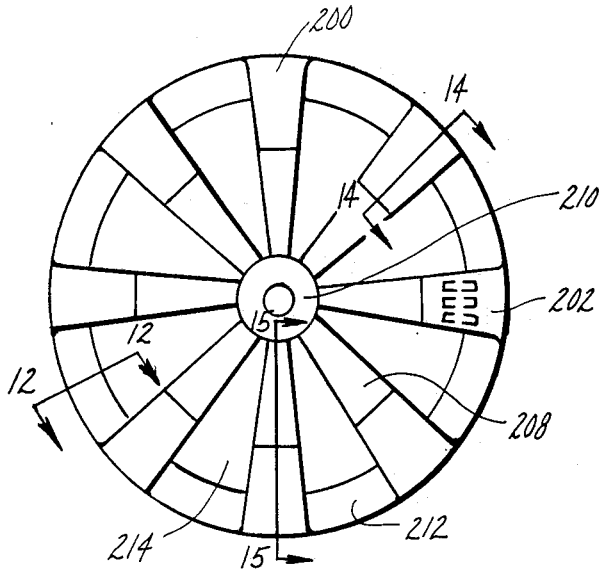
FIG. 11 is a top view of a multiple socket ring.
Figure 12:
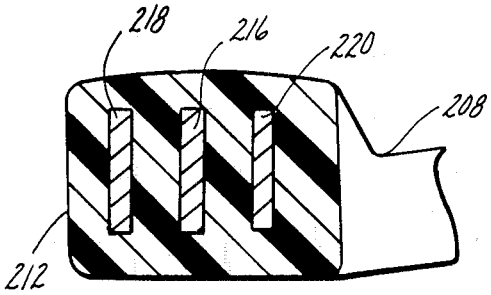
FIG. 12 is a partial cross section of the ring taken along the line 12—12 of FIG. 11.
Figure 13:
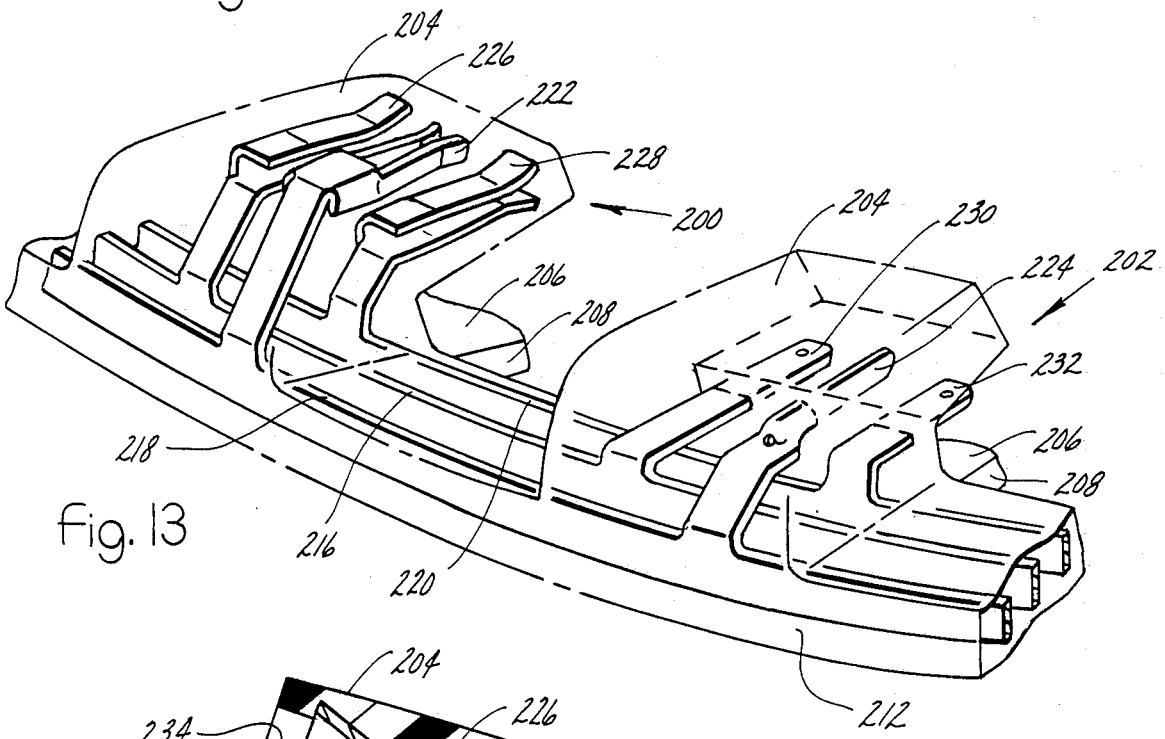
FIG. 13 is a perspective detail of a plug and a socket on the ring.
Figure 14:
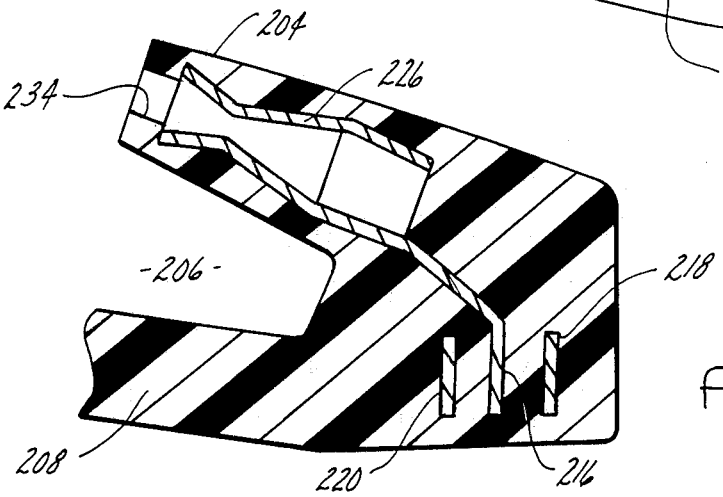
FIG. 14 is a partial cross section of the ring taken along the line 14—14 of FIG. 11.

FIGS. 11 through 15 illustrate a multiple socket ring connector for use with the above plug and socket assemblies. Although not limited specifically to seven sockets 200 and a plug 202, FIG. 11 illustrates in plan view the general configuration. The sockets generally denoted by 200 and plug generally denoted by 202 all extend toward the ring center with the shape of the contact extension 204 and contact cavity 206 configured to engage the plug and socket bodies above. Beneath each socket 200 and the plug 202 is an integral rib 208 extending to a raised central ring 210. Although the integral rib 208 is shown at a relatively modest angle from the horizontal, the rib 208 and contact extension 204 may be constructed oblique to the horizontal by the same angle as the spaced parallel oblique planes 46 and 48 are to the axis 29 (FIG. 3). With such construction the cables 24, 26 will extend horizontally from the ring connector. Between the ribs 208 and the peripheral ring 212 are pie shaped openings 214. Within the peripheral ring 212 are three circular metal electric conductors 216, 218 and 220. Outside conductor 218 comprises the ground and is integrally attached to the ground contacts 222 in the sockets 200 and the ground prong 224 in plug 202 as best shown in FIG. 13. Similarly, hot conductors 216 and 220 are integrally connected to hot contacts 226 and 228 respectively in the sockets 200 and hot prongs 230 and 232 in the plug 202. As shown the conductors are completely encased in molded plastic (as shown ghosted in FIG. 13) with the exception of the prongs 224, 230 and 232. Apertures 234 extend into the contacts 222, 226 and 228 such as within the channel of contact 226 as shown in FIG. 14. As with the single socket and plug configuration, the ring engagement with a plug or socket tightens with pulling on the cables. As shown each of the rings 216, 218 and 220 with all respective prongs and contacts may be stamped from sheet metal as single parts or built up by soldering, brazing or welding prong and contact components to rings. The plastic or rubber can then be cast or injection molded about sets of completed rings positioned in a mold cavity.

Figure 16:
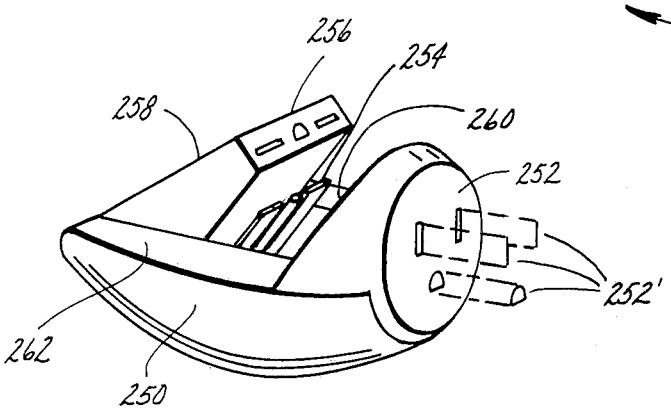
FIG. 16 is a perspective view of an in line adapter.

FIG. 16 illustrates an "in-line" adapter 250 to connect a standard 110 v plug or socket to applicant's plug or socket. The adapter 250 includes a conventional socket 252 at one end and a prong cavity 254 and socket extension 256 toward the other end. The body of the adapter is generally bulbous with parallel oblique planes 258 and 260 and horizontal upper surfaces 262. Configured with a conventional socket 252, the prong cavity 254 contains the three prongs necessary to form applicant's plug. Alternatively, socket 252 may be configured as a plug with conventional prongs 252' and contact within the socket extension 256 to form applicant's socket. The adapter may be a solid plastic molde shape containing three substantially integral and parallel conductors in the same manner as the ring above or, alternatively, separate male and female parts substantially as shown in FIGS. 2, 4 and 5 but modified for a conventional plug or socket at the grommet end. Joined with a plug 20 or socket 22, the adapter 250 forms a bulbous shape almost identical to that shown in FIGS. 1 and 3.

Figure 17:
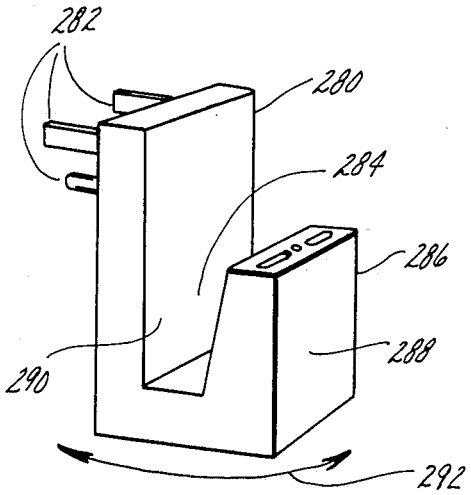
FIG. 17 is a perspective view of an L-shaped adapter.

FIG. 17 illustrates an "L-shaped" adapter 280 specifically configured to plug into a conventional wall socket and hang therefrom. Conventional prongs 282 extend from the adapter 280 body on the side opposite a prong cavity 284 and socket extension 286, the latter being configured with parallel planes 288 and 290. The adapter 280 is preferably configured with contacts in the socket extension 286 to receive applicant's plug. As with the other adapter 250 above, the L-shaped adapter can be formed with a plastic molded shape containing three substantially parallel conductors extending from the prongs 282 into the socket extension 286 to form contact therein. In both adapters each conductor can be formed from a single metal blank to provide the prong at one end and the contact at the other end, or they can be built up from components.

The adapter 280 positions applicant's plug 20 with the cable 24 substantially hanging downwardly. In the event the cable is pushed or pulled the adapter 280 will tend to swing as indicated by arrow 292 about the conventional prongs 282 inserted in a conventional wall socket (not shown). The prongs 282 will tend to bind in the conventional socket thereby lessening the likelihood that the adapter will be disengaged from the wall socket.

Returning to FIGS. 1 through 5, the applicant's plug and socket combination as joined together encloses the male parts 28 of each with the exception of the small portions 44, these being tightly affixed to the female parts 30 by the screws 64. With reasonable manufacturing accuracy the combination is substantially weather resistant because of the flat mating surfaces 40, 42, 46 and 48. As an alternative to provide a substantially weather proof seal, a thin soft rubber layer may be adhesively affixed adjacent the periphery of each surface 40, 42, 46 and 48 of either or both the plug 30 and the socket 22. Tension on the cables thereby assists in weatherproofing as distinguished from conventional plugs and sockets which expose the prongs to the environment upon tension in the cables. Other sealing means such as tongue and groove or a separate rubber seal in the groove may also be incorporated into the surfaces 40, 42, 46 and 48 to provide more positive sealing means.

As disclosed in FIGS. 1 through 5 the plug 20 and socket 22 slide together and apart, however, as an option more positive latching means can be incorporated by providing a ball detent and socket in any pair of the mating surfaces that are oblique to the axis 29. Surfaces 42 and 46 are an example.

To differentiate between a 110 v set of plugs and sockets and a 220 v set of plugs and sockets, the spacing of the hot prongs from the ground prong and the hot contacts from the ground contact may be varied. As another alternative the configuration or size of the prongs and the apertures in the socket extension may be varied.

I claim:

1. Mutually engageable plug and socket constructions each comprising a body, a prong cavity and a contact extension formed in the body, said contact extension located between the prong cavity and one end of the body, said prong cavity extending into the body beneath the contact extension and generally opening toward the end of the body opposite the contact extension, and said prong cavity and contact extension substantially complementary in form to provide engagement of the prong cavities of plugs with the contact extensions of sockets, a pair of spaced surfaces on each body, at least a portion of each spaced surface extending the full width of the body, said surfaces at least partially overlapped whereby one surface forms a portion of the contact extension above the prong cavity and the other surface forms a wall of the prong cavity descending beneath the contact extension, and said surfaces being substantially complementary to each other to provide for said mutual engagement of plug prong cavities with socket contact extensions.

2. The mutually engageable plug and socket constructions of claim 1 wherein said pair of spaced surfaces on each body are parallel planar surfaces.

3. The mutually engageable plug and socket constructions of claim 1 wherein the external surfaces of a plug and a socket when joined form an overall generally bulbous shape.

4. The mutually engageable plug and socket constructions of claim 1 wherein the prong cavities and contact extensions of a plug and socket when joined are completely enclosed within the combined plug and socket bodies.

5. The mutually engageable plug and socket constructions of claim 1 wherein said pair of spaced surfaces on each body are oblique to a central axis through the body.

6. The mutually engageable plug and socket constructions of claim 5 wherein the plug or socket body includes means for an electric cable to enter the plug or socket along the central axis at the end of the plug body or socket body opposite the contact extension thereof.

7. The mutually engageable plug and socket constructions of claim 1 wherein the body comprises a male portion and a female portion, said male portion substantially including both the prong cavity and the contact extension, the femal portion being formed with a cavity to receive at least a portion of the male portion including portions of the prong cavity and the contact extension.

8. The mutually engageable plug and socket constructions of claim 7 wherein said male portion includes a plurality of walls extending beyond the prong cavity and contact extension for engagement within the cavity of the female portion.

9. The mutually engageable plug and socket constructions of claim 7 wherein the spaced surface forming a portion of the contact extension is extended to form a surface of the female portion.

10. The mutually engageable plug and socket constructions of claim 9 wherein said pair of spaced surfaces on each body are parallel planar surfaces including the extended surface on the female portion.

11. The mutually engageable plug and socket construction of claim 10 wherein the male portion and female portion are joined by a hinge at the juncture of the extended surface on the female portion and the spaced surface on the contact extension.

12. The mutually engageable plug and socket constructions of claim 7 including a plurality of generally U-shaped electrically conductive prongs to form a plug, one side of each U-shape extending into the prong cavity to form a prong and the other side of the U-shape adapted for attachment of a cable conductor wire.

13. The mutually engageable plug and socket constructions of claim 12 wherein said prongs are formed with barbs engageable in said male portion to prevent extraction therefrom.

14. The mutually engageable plug and socket constructions of claim 7 including a plurality of generally U-shaped electrically conductive contacts to form a socket, one side of each U-shape extending into a hole formed in the contact extension to form a contact and the other side of the U-shape adapted for attachment of a cable conductor wire.

15. The mutually engageable plug and socket constructions of claim 14 wherein said contacts are formed with barbs engageable in said male portion to prevent extraction therefrom.

16. A plug or socket construction comprising a body, a prong cavity and a contact extension formed in the body, said contact extension adjacent one end of the body, a pair of spaced parallel planar surfaces on the body, at least a portion of each spaced planar surface extending the full width of the body, said planar surfaces at least partially overlapped whereby the upper outermost overlapping planar surface forms the upper wall of the contact extension and the lower inner underlying planar surfaces extends into the body beneath the contact extension to form a wall of the prong cavity, said prong cavity being shaped substantially complementary to said contact extension, extending beneath the contact extension into the body and opening toward the end of the body opposite the contact extension.

17. The plug or socket construction of claim 16 wherein the plug body and socket body planar parallel surfaces, prong cavity and contact extension are substantially identical, whereby the contact extension of each slidably engages the prong cavity of the other.

18. The plug or socket construction of claim 16 wherein the prong cavities and the contact extensions of a plug and socket joined together are completely enclosed within the joined plug and socket bodies.

19. The plug or socket construction of claim 16 wherein the prong cavity and contact extension are spaced from the outside surface of the body.

20. The plug or socket construction of claim 16 wherein the planar surfaces are oblique to a central axis through the body.

21. The plug or socket construction of claim 20 wherein the external surfaces of a plug and a socket are each substantially identical and form a generally bulbous shape when joined together.

22. The plug or socket construction of claim 20 wherein the plug or socket includes means for an electric cable to enter the plug or socket along the central axis at the end of the body opposite the contact extension.

23. An adaptive plug or socket comprising a generally oblong body having a conventional plug or socket at one end thereof, a prong cavity and contact extension formed in the body toward the opposite end, said prong cavity extending into the body beneath the contact extension and opening generally toward the conventional plug or socket end of the body, a pair of spaced surfaces on the body,,at least a portion of each spaced surface extending the full width of the body, said surfaces at least partially overlapped whereby one surface forms a portion of the contact extension extending above the prong cavity and extends to the opposite end of the body and the other surface forms a wall of the prong cavity descending beneath the contact extension, the prong cavity being substantially complementary to the contact extension.

24. The adaptive plug or socket of claim 23 wherein said spaced surfaces are planar and parallel.

25. The adaptive plug or socket of claim 23 wherein said pair of spaced surfaces are oblique to a central axis extending between the ends of the body.

26. An adaptive plug and socket comprising a generally L-shaped body, the short end of the L-shaped body being formed into a contact extension and separated from the long end of the L-shaped body by a prong cavity, the prong cavity and contact extension being substantially complementary to each other, a plurality of conventional plug prongs arrayed in conventional positions extending from the long end of the L-shaped body, a pair of spaced surfaces on the L-shaped body, at least a portion of each spaced surface extending the full width of the body, said surfaces at least partially overlapped whereby one surface forms a portion of the contact extension extending over the prong cavity, the surface being on the outside of the short end of the L-shaped body and the other surface forming a wall of the prong cavity opposite the contact extension.

27. The adaptive plug and socket of claim 26 wherein said plurality of conventional prongs extend from the side of the long end of the L-shaped body opposite the surface forming a portion of the prong cavity.

* * * * *